US007675493B2

(12) United States Patent
Yoon et al.

(10) Patent No.: US 7,675,493 B2
(45) Date of Patent: Mar. 9, 2010

(54) DRIVING CIRCUIT FOR ORGANIC LIGHT EMITTING DIODE, DISPLAY DEVICE USING THE SAME AND DRIVING METHOD OF ORGANIC LIGHT EMITTING DIODE DISPLAY DEVICE

(75) Inventors: Soo Young Yoon, Goyang-si (KR); Min Doo Chun, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 922 days.

(21) Appl. No.: 11/292,873

(22) Filed: Dec. 2, 2005

(65) Prior Publication Data

US 2006/0284801 A1 Dec. 21, 2006

(30) Foreign Application Priority Data

Jun. 20, 2005 (KR) ..... 10-2005-0053120

(51) Int. Cl.
*G09G 3/32* (2006.01)

(52) U.S. Cl. ..... 345/82; 345/92; 345/84; 345/76

(58) Field of Classification Search ..... 345/82, 345/84, 76, 92
See application file for complete search history.

(56) References Cited

U.S. PATENT DOCUMENTS 7,116,058 B2 * 10/2006 Lo et al. ..... 315/169.1
2002/0158829 A1 * 10/2002 Yamazaki et al. ..... 345/92
2004/0017336 A1 * 1/2004 Chang ..... 345/84
2005/0007316 A1 * 1/2005 Akimoto et al. ..... 345/76

FOREIGN PATENT DOCUMENTS

CN 1278635 A 1/2001
CN 1588517 A 3/2005

OTHER PUBLICATIONS

Office Action for corresponding Chinese Patent Application Serial No. 2005101141173, dated Dec. 7, 2007.

* cited by examiner

*Primary Examiner*—Richard Hjerpe
*Assistant Examiner*—Leonid Shapiro
(74) *Attorney, Agent, or Firm*—Brinks Hofer Gilson & Lione

(57) ABSTRACT

An organic light emitting diode drive circuit includes an organic light emitting diode which emits light with a current, a first transistor, a second transistor and a stress compensation circuit. The first transistor supplies a data voltage to a first node in response to a scan pulse. The second transistor controls a current flowing in the organic light emitting diode by the data voltage on the first node. The stress compensation circuit discharges the first node in response to a reset pulse. The organic light emitting diode driving circuit is adaptive to compensate characteristic changes of the organic light emitting diode drive circuit.

9 Claims, 12 Drawing Sheets

DRIVING CIRCUIT FOR ORGANIC LIGHT EMITTING DIODE, DISPLAY DEVICE USING THE SAME AND DRIVING METHOD OF ORGANIC LIGHT EMITTING DIODE DISPLAY DEVICE

This application claims the benefit of the Korean Patent Application No. P2005-53120 filed on Jun. 20, 2005, which is hereby incorporated by reference in its entirety.

BACKGROUND

1. Technical Field

The present invention relates to an organic light emitting diode display device, and more particularly to an organic light emitting diode driving circuit with minimized characteristic changes.

2. Related Art

Various flat panel display devices gradually replace a cathode ray tube (CRT) because they may be compact, light and thin. Flat panel display devices include a liquid crystal display (LCD), a field emission display (FED), a plasma display panel (PDP), a light emitting diode (LED) display device and so on.

An LED display device uses an LED which emits light by recombining electrons and holes. The LED display device is divided into an inorganic LED display device which uses inorganic compounds and an organic light emitting diode (OLED) display device which uses organic compounds. OLED display devices are expected to be a next generation display device because they have many advantages such as low voltage driving, self-luminescence, thinness, wide viewing angle, rapid response speed and high contrast.

An OLED is generally made up of an electron injection layer, an electron transport layer, a light emitting layer, a hole transport layer and a hole injection layer which are deposited between a cathode and an anode. In an OLED, if a designated voltage is applied between the anode and the cathode, electrons generated from the cathode move to the light emitting layer through the electron injection layer and the electron transport layer, and holes generated from the anode move to the light emitting layer through the hole injection layer and the hole transport layer. Accordingly, electrons and holes supplied from the electron transport layer and the hole transport layer are recombined in the light emitting layer, thereby emitting light.

FIG. 1 illustrates an active matrix type of OLED display device 10 using an OLED. The OLED display device 10 includes an OLED panel 13 having n×m number of pixels P[i,j]. P[i,j] is a pixel located at the $i^{th}$ row and the $j^{th}$ column, where i is a positive integer which is equal to or smaller than n, and j is a positive integer which is equal to or smaller than m. The pixels are arranged in n×m matrix at an area which is defined by n numbers of gate lines G1 to Gn (n is a positive integer) and m numbers of data lines D1 to Dm (m is a positive integer). A gate drive circuit 12 drives the gate lines G1 to Gn of the OLED panel 13 and a data drive circuit 11 drives the data lines D1 to Dm of the OLED panel 13. The m number of power voltage supply lines S1 to Sm are arranged in parallel to the data lines D1 to Dm to supply the high potential power voltage Vdd to each pixel P[i,j].

The gate drive circuit 12 supplies scan pulses to the gate lines G1 to Gn to sequentially drive the gate lines G1 to Gn. The data drive circuit 11 converts a digital data voltage input from the outside into an analog data voltage. The data drive circuit 11 supplies the analog data voltage to the data lines D1 to Dm whenever the scan pulse is supplied. Each of the pixel P[i,j] receives the data voltage from the $j^{th}$ data line Dj to generate a light corresponding to the data voltage when the scan pulse is supplied to the $i^{th}$ gate line Gi.

Each pixel P[i,j] includes an OLED having an anode connected to the $j^{th}$ power voltage supply line Sj. An OLED drive circuit 15 is connected to the cathode of the OLED and the $i^{th}$ gate line Gi and the $j^{th}$ data line Dj to supply a low potential power voltage Vss. The OLED drive circuit 15 includes a first transistor T1 and a second transistor T2 and a storage capacitor Cs. The first transistor T1 supplies the data voltage from the $j^{th}$ data line Dj to a first node N1 in response to the scan pulse from the $i^{th}$ gate line Gi. The second transistor T2 controls a current flowing in the OLED in response to the voltage of the first node N1. The storage capacitor Cs is charged with the voltage on the first node N1.

FIG. 2 illustrates driving waveforms of the OLED drive circuit 15. In FIG. 2, '1F' is one frame period, '1H' is one horizontal period, 'Vg_i' is a gate voltage supplied from the $i^{th}$ gate line Gi', 'Psc' is a scan pulse, 'Vd_j' is a data voltage supplied from the $j^{th}$ data line Dj, '$V_{N1}$' is a voltage on the first node N1, and '$I_{OLED}$' is a current flowing through the OLED. Referring to FIGS. 1 and 2, the first transistor T1 is turned on to supply the data voltage Vd supplied from the data line Dj to the first node N1 when the scan pulse is supplied through the gate line Gi. The data voltage Vd supplied to the first node N1 is charged to the storage capacitor Cs and supplied to a gate terminal of the second transistor T2. In this way, the second transistor T2 is turned on by the supplied data voltage Vd, and the current flows through the OLED. Because the current flowing through the OLED is generated by the high potential power voltage Vdd, the current is proportional to the magnitude of the data voltage Vd applied to the second transistor T2. When the first transistor T1 is turned off, the second transistor T2 remains turned on with the first node voltage $V_{N1}$ from the storage capacitor Cs. As a result, the current which flows through the OLED may be controlled until the data voltage Vd of the next frame is supplied.

In FIG. 2, a positive data voltage Vd is applied for a long time to the gate electrode of the second transistor T2. An accumulated gate bias stress may be generated in the second transistor T2 with the positive data voltage Vd, as shown in FIG. 3. The accumulated gate-bias stress may cause deterioration, which in turn may cause characteristic changes, as shown in FIG. 4A. FIG. 4A represents a characteristic change of a transistor caused by a positive gate bias stress, and FIG. 4B represents a characteristic change of a transistor caused by a negative gate bias stress. The arrow marks in FIGS. 4A and 4B represent a threshold voltage change of the second transistor T2. The characteristic change of the OLED drive circuit, in particular, the second transistor T2 may deteriorate reliability of operations of the OLED drive circuit 15 by changing the current flowing in the OLED. Reliability of the entire OLED display device may be further affected.

SUMMARY

By way of example only, in one embodiment, an organic light emitting diode drive circuit includes an organic light emitting diode which emits light by a current, a first switch to supply a data voltage to a first node in response to a scan pulse, a second switch to control a current flowing in the organic light emitting diode by the data voltage on the first node, and a stress compensation circuit to discharge the first node in response to a reset pulse. The stress compensation circuit may include a third switch. The data voltage rises from a first low potential reference voltage, and the scan pulse and the reset pulse rise from a second low potential reference voltage. The second low potential reference voltage may be lower than the first low potential reference voltage. In the organic light emitting diode drive circuit, generation of the reset pulse may be delayed by a designated time, for example, ½ frame period from generation of the scan pulse. The first to third switches may include a transistor.

In other embodiment, an organic light emitting diode drive circuit includes a first switch to supply a data voltage to a first node in response to a scan pulse; a second switch to control a current flowing in an organic light emitting diode by the data voltage on the first node; and a stress compensation circuit that supplies to the first node a compensation voltage of which the polarity is different from the polarity of the data voltage at the first node. The stress compensation circuit may include a third switch which is turned on subsequent to the first switch. The third switch supplies to the first node a voltage that is lower than a low potential reference voltage of the data voltage.

In another embodiment, an organic light emitting diode display device includes data lines and gate lines which cross each other; a gate drive circuit to supply a scan pulse to the gate lines; a data drive circuit to supply a video data voltage to the data lines; an organic light emitting diode which emits light by a current; and an organic light emitting diode drive circuit. The organic light emitting diode drive circuit includes a first switch to supply the data voltage to a first node in response to the scan pulse, a second switch to control a current flowing in the organic light emitting diode by the data voltage on the first node, and a third switch to discharge the first node in response to a reset pulse.

Alternatively, or additionally, the organic light emitting diode display device includes a stress compensation circuit that supplies to the first node a compensation voltage. The compensation voltage has a polarity different from a polarity of the data voltage at the first node.

In further another embodiment, a driving method of an organic light emitting diode display device is provided. A scan pulse is supplied to a plurality of gate lines. A data voltage is supplied to a plurality of data lines which are configured to intersect the gate lines. A voltage of a driving transistor of an organic light emitting diode drive circuit is controlled with application of a reset voltage.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

These and other objects of the invention will be apparent from the following detailed description of the embodiments with reference to the accompanying drawings, in which.

DETAILED DESCRIPTION OF THE PREFERRED EMBODIMENT

Figure 1:
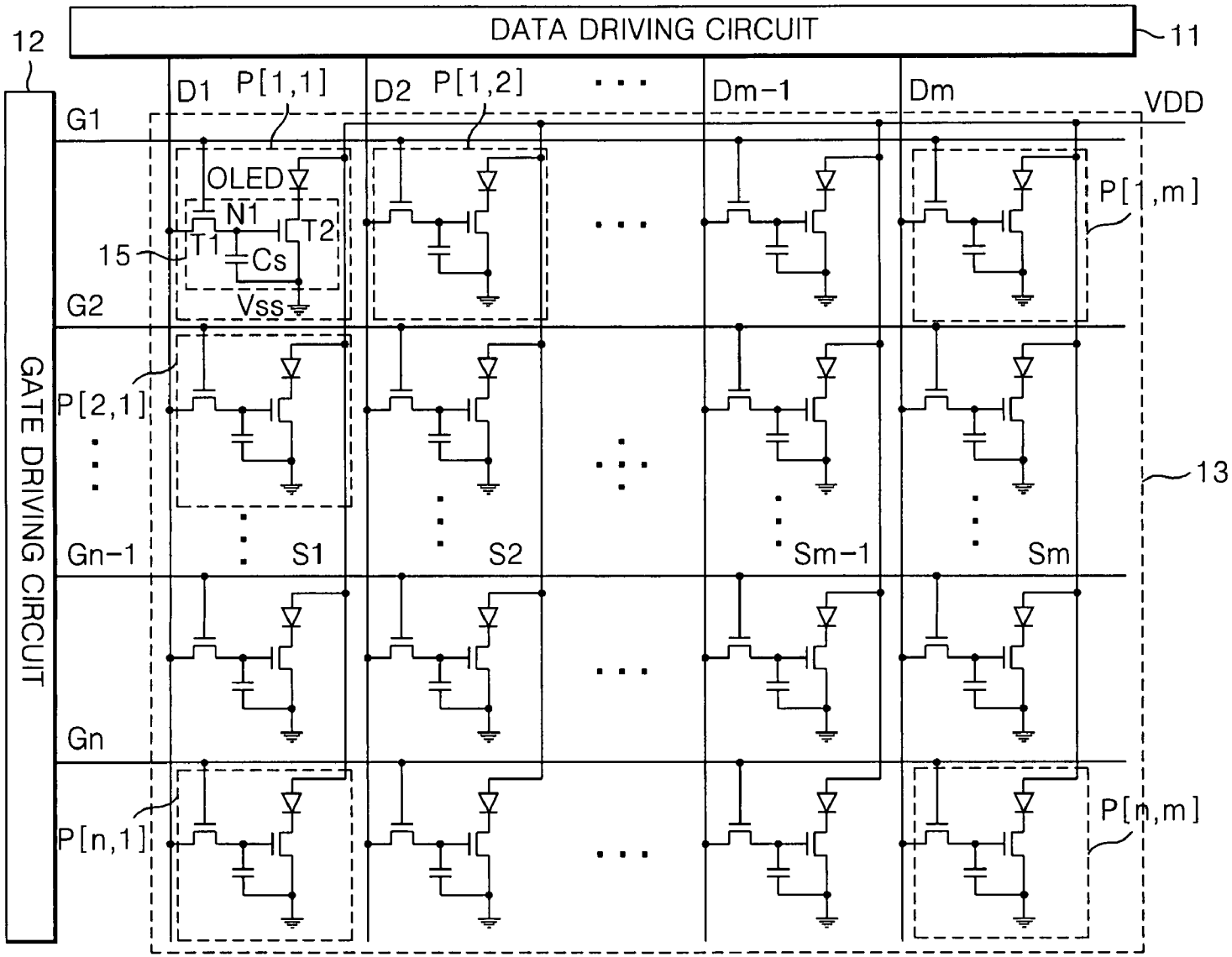
FIG. 1 RELATED ART
FIG. 1 is a block diagram illustrating a related art organic light emitting diode display device.
Figure 2:
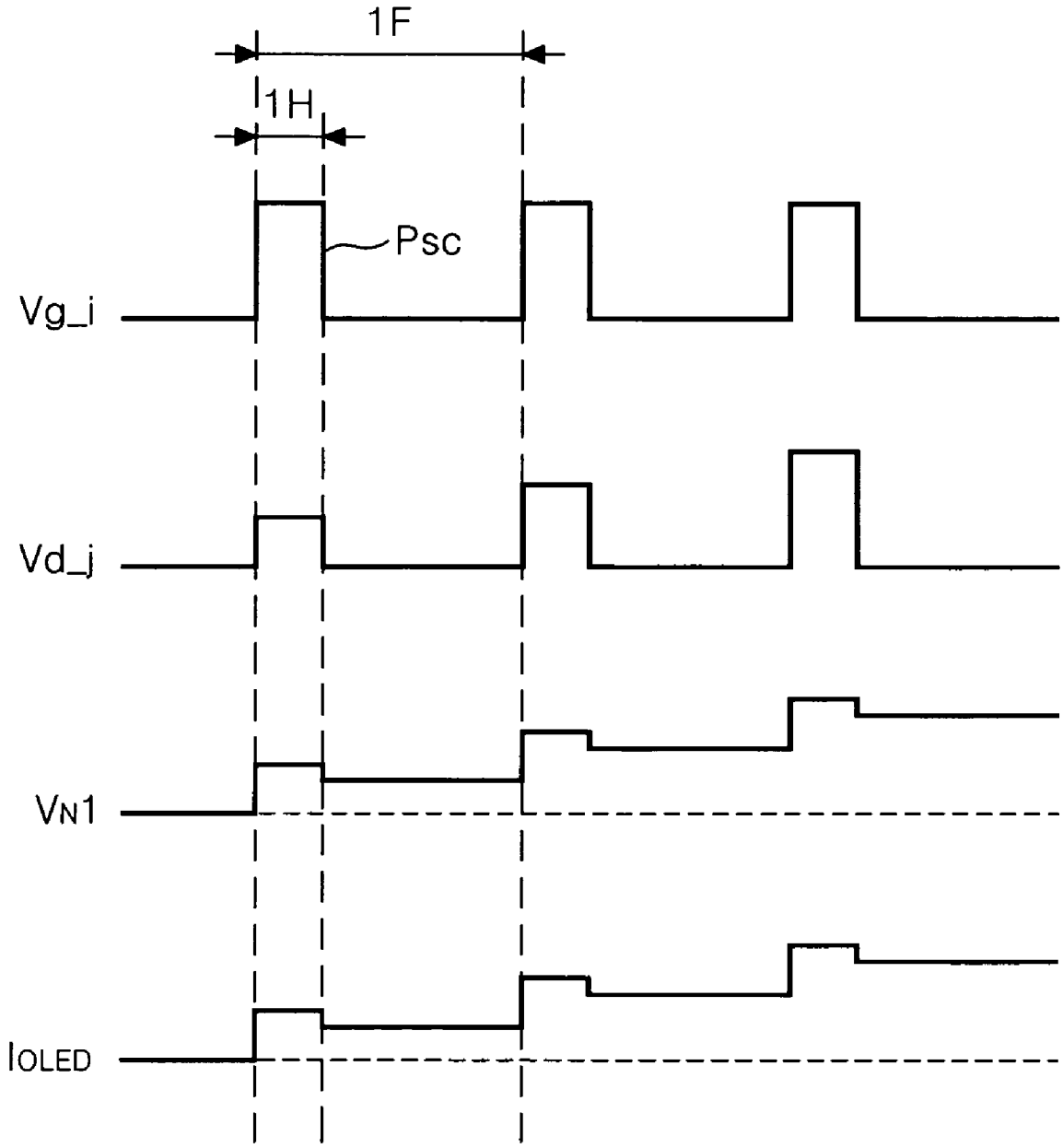
FIG. 2 RELATED ART
FIG. 2 illustrates driving waveforms of the organic light emitting diode drive circuit of FIG. 1.
Figure 3:
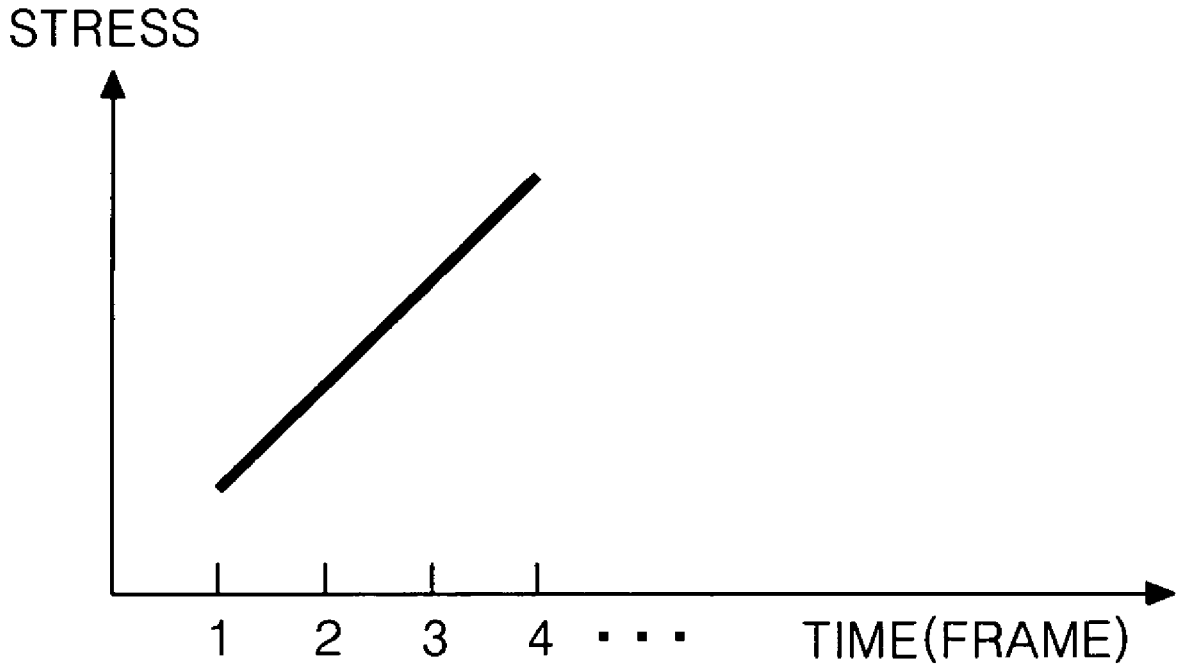
FIG. 3 RELATED ART
FIG. 3 illustrates an accumulated gate bias stress according to a voltage supply time.
Figure 4A:
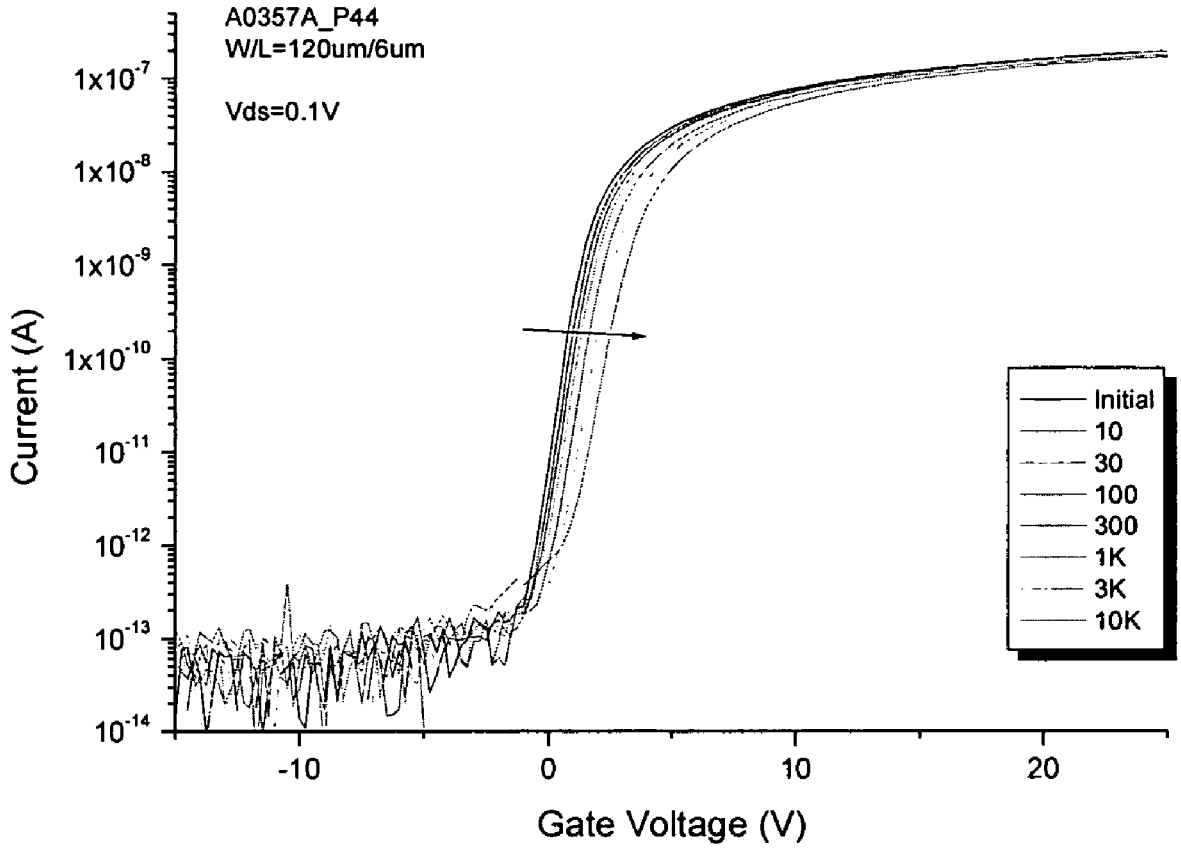
FIG. 4A RELATED ART
FIG. 4A illustrates an exemplary characteristic change caused by a positive gate bias stress.
Figure 4B:
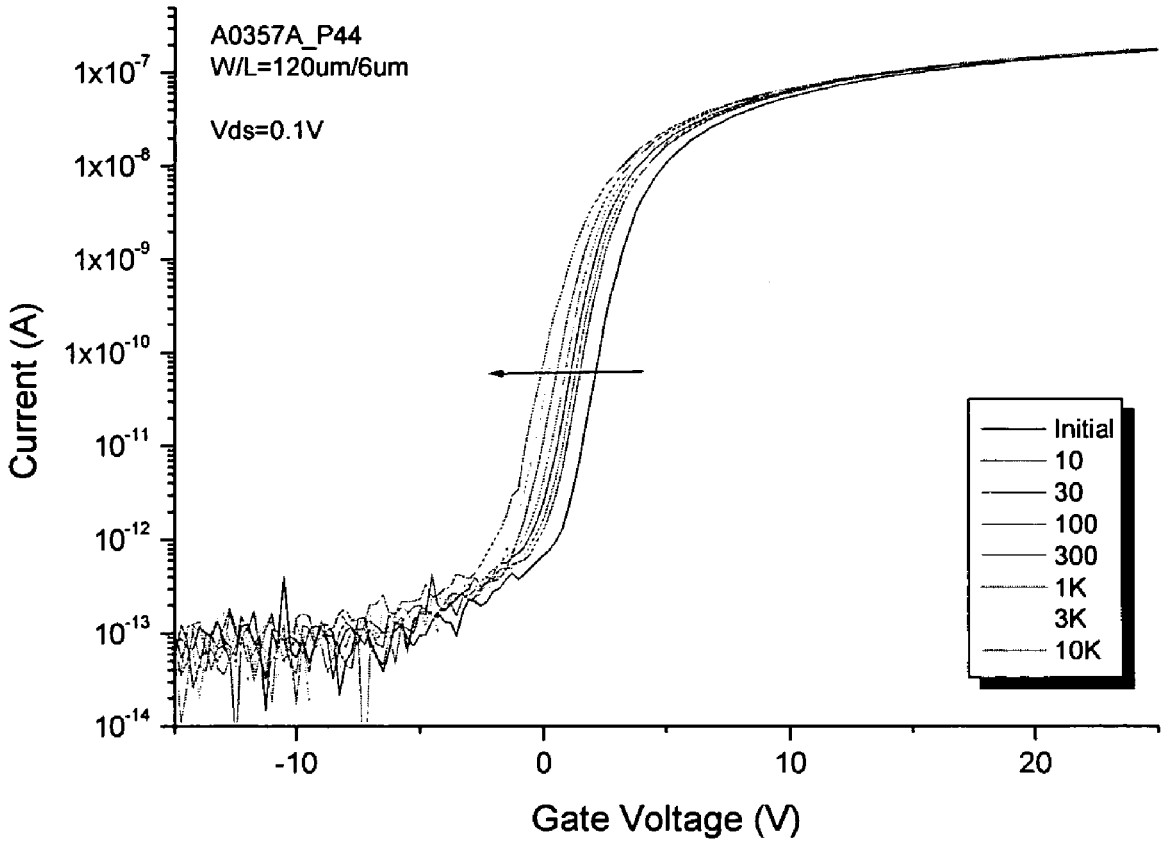
FIG. 4B RELATED ART
FIG. 4B illustrates an exemplary characteristic change caused by a negative gate bias stress.
Figure 5:
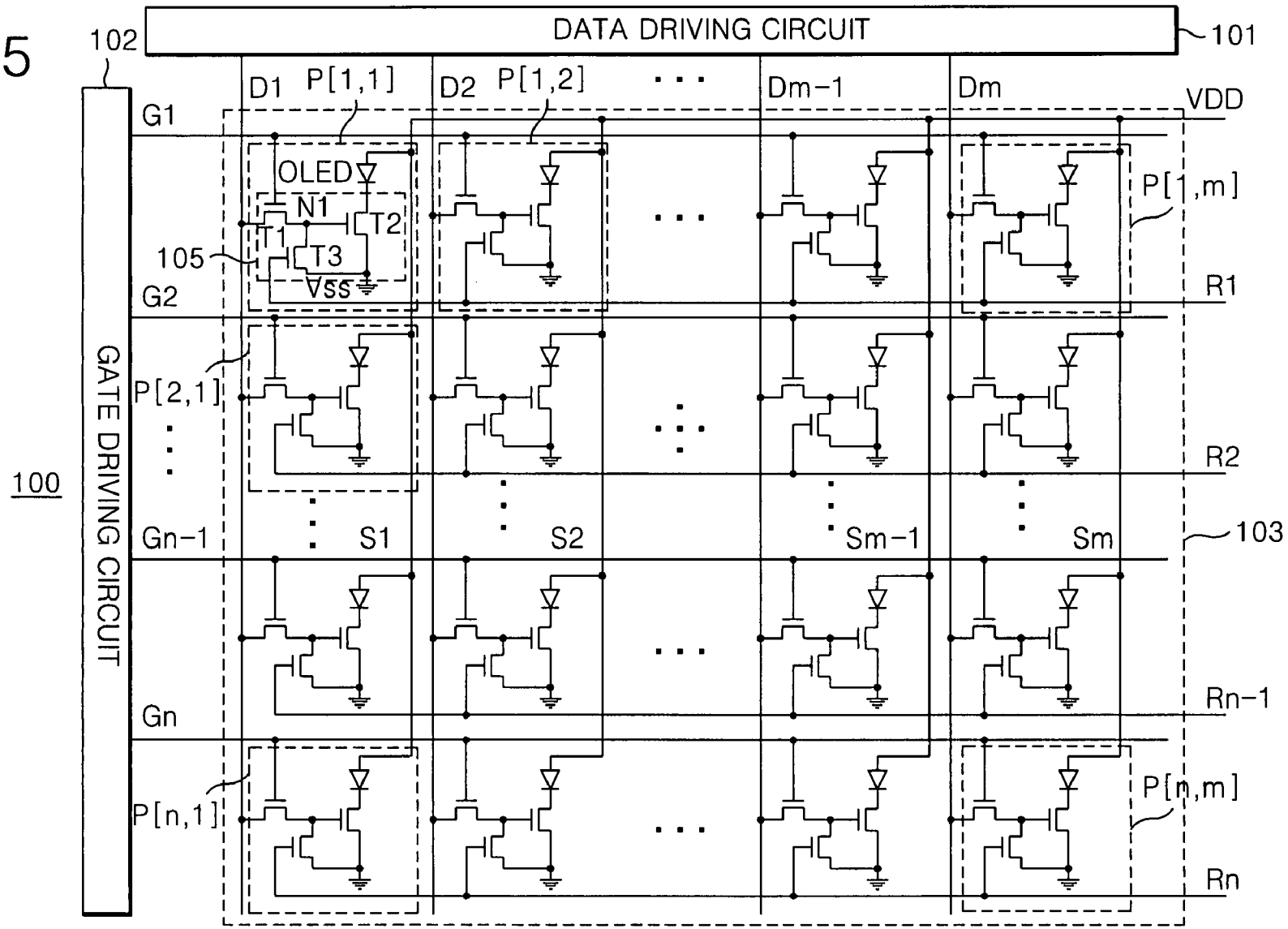
FIG. 5 is a block diagram illustrating one embodiment of an organic light emitting diode display device.

FIG. 5 illustrates one embodiment of an OLED display device 100 that includes an OLED panel 103 having n×m number of pixels P[i,j]. The pixels P[l, j] are arranged in n×m matrix at an area which is defined by n numbers of gate lines G1 to Gn and m numbers of data lines D1 to Dm. A gate drive circuit 102 drives the gate lines G1 to Gn of the OLED panel 103, and a data drive circuit 101 drives the data lines D1 to Dm of the OLED panel 103. The m number of power voltage supply lines S1 to Sm are arranged in parallel to the data lines D1 to Dm to supply the high potential power voltage Vdd to each pixel P[i,j]. In the OLED display device 100, reset lines R1 to Rn are arranged in parallel to the gate lines G1 to Gn to supply a reset signal to each pixel P[i,j].

The gate drive circuit 102 supplies scan pulses to the gate lines G1 to Gn to sequentially drive the gate lines G1 to Gn. The data drive circuit 101 converts a digital data voltage input from the outside into an analog data voltage. The data drive circuit 101 supplies the analog data voltage to the data lines D1 to Dm whenever the scan pulse is supplied. Each of the pixel P[i,j] receives the data voltage Vd_j from the $j^{th}$ data line Dj to generate a light corresponding to the data voltage when the scan pulse Psc is supplied to the $i^{th}$ gate line Gi. Each pixel P[i,j] includes an OLED having an anode connected to the $j^{th}$ power voltage supply line Sj. An OLED drive circuit 105 is connected to a cathode of the OLED and to the $i^{th}$ gate line Gi, the $j^{th}$ data line Dj and the $i^{th}$ reset line Ri to supply a low potential power voltage Vss.

The OLED drive circuit 105 includes a first transistor T1, a second transistor T2 and a third transistor T3. The first to third transistors T1-T3 may act as a switch. In other embodiments, other types of a switch may be used. The first transistor T1 supplies the data voltage from the $j^{th}$ data line Dj to a first node N1 in response to the scan pulse from the $i^{th}$ gate line Gi. The second transistor T2 controls a current flowing in the OLED in response to the voltage of the first node N1. The third transistor T3 discharges the first node N1 in response to the reset pulse from the $i^{th}$ reset line Ri. The third transistor T3 may compensate the stress of the second transistor T2 by controlling the first node as a stress compensation circuit. TFTs for use with the OLED drive circuit 105 may be implemented with an amorphous silicon type MOSFET TFT or a polysilicon type MOSFET TFT.

Figure 6:
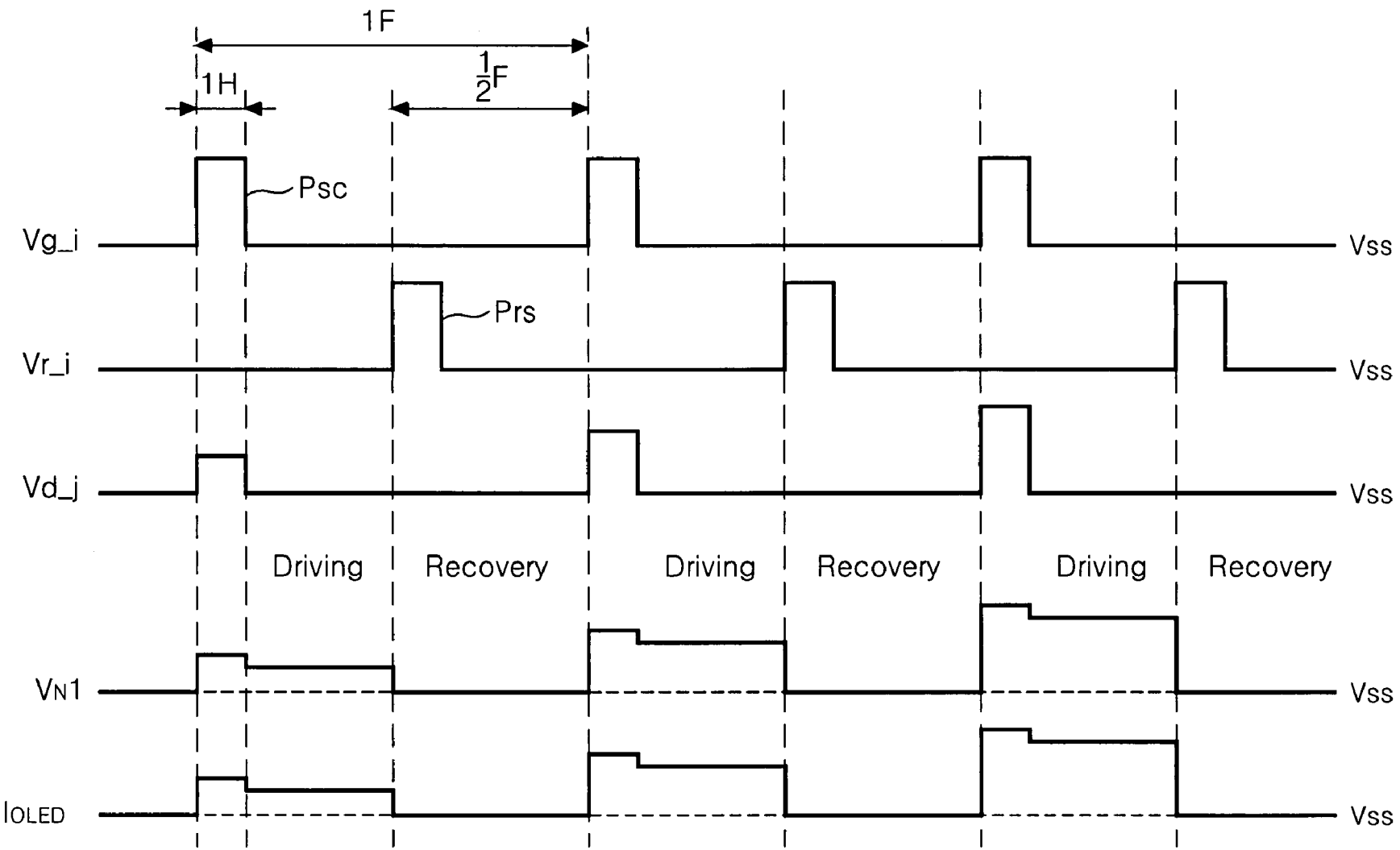
FIG. 6 illustrates one exemplary driving waveforms of the organic light emitting diode drive circuit of FIG. 5.

The driving waveform of the OLED drive circuit 105 is as shown in FIG. 6. In FIG. 6, '1F' is one frame period, '1H' is one horizontal period, 'Vg_i is a gate voltage supplied from the $i^{th}$ gate line Gi', 'Psc' is a scan pulse, 'Vd_j' is a data voltage supplied from the $j^{th}$ data line Dj, '$V_{N1}$' is a voltage on the first node N1, and '$I_{OLED}$' is a current flowing through the OLED. Further, 'Vr_i' is a reset voltage supplied from the $i^{th}$ reset line Ri, and 'Prs' is a reset pulse.

Referring to FIGS. 5 and 6, the first transistor T1 is turned on to supply the data voltage Vd supplied from the $j^{th}$ data line Dj to the first node N1 when the scan pulse Psc is supplied through the $i^{th}$ gate line Gi. The data voltage Vd supplied to the first node N1 is supplied to a gate terminal of the second transistor T2. The second transistor T2 is turned on by the supplied data voltage Vd, and the current flows through the OLED. Because the current flowing through the OLED is generated by the high potential power voltage Vdd, the current is proportional to the magnitude of the data voltage Vd applied to the second transistor T2. When the first transistor T1 is turned off, the voltage VN1 on the first node N1 by the data voltage Vd stays until the third transistor T3 is turned on by the reset pulse Prs to discharge the first node N1. Accordingly, the second transistor T2 remains the turn-on state until the reset pulse Prs is supplied. At this moment, the reset pulse Prs supplied from the $i^{th}$ reset line Ri is generated with a time difference of ½ frame period with respect to the scan pulse for each frame period. The first node N1 is discharged by the third transistor T3 with the reset pulse Prs generated having the time difference of ½ frame period with the scan pulse Psc. Thus, the second transistor T2 has a stress recovery period of ½ frame period.

Figure 7A:
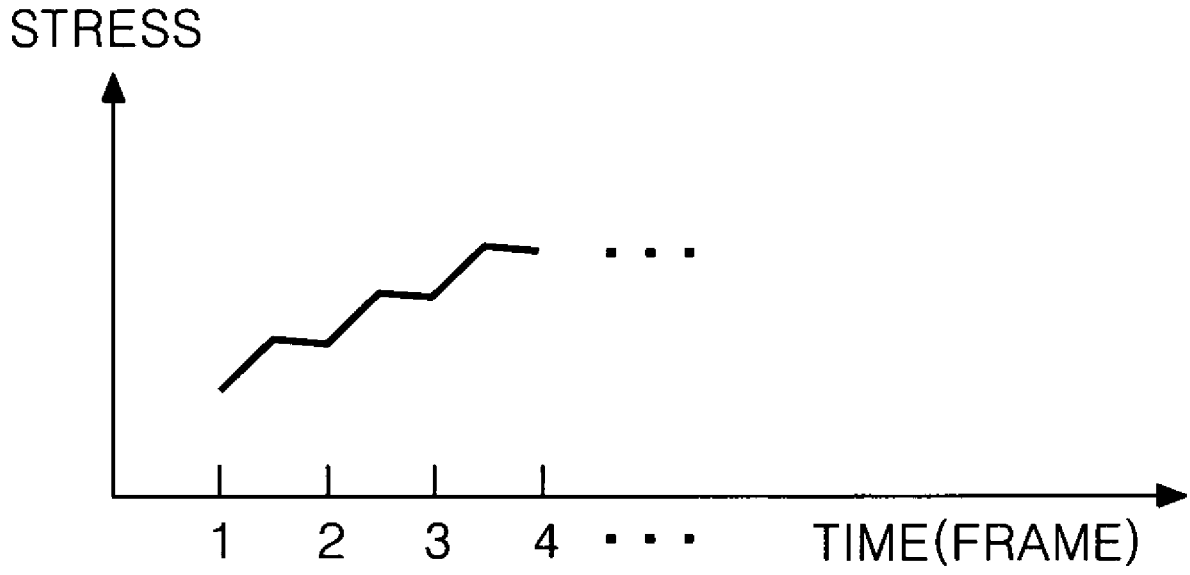
FIG. 7A illustrates positive gate bias stress experienced by the organic light emitting diode drive circuit of FIG. 5.

FIG. 7A illustrates an exemplary positive bias stress experienced by the OLED drive circuit 105. As shown in FIG. 7A, the gate bias stress which is accumulated in the second transistor T2 for the turn-on period of ½ frame period may decrease for the turn-off period of ½ frame period. The second transistor T2 of the OLED drive circuit 105 remains the turn-on state for the ½ frame period, and then the second transistor T2 remains the turn-off state for the ½ frame period. Accordingly, any characteristic change of the second transistor T2 generated during the turn-on state may be recovered when it is in the turn-off state. As a result, the characteristic change caused by the gate bias stress of the second transistor T2 may be prevented and reliability for the operation of the OLED drive circuit 105 may improve.

Figure 7B:
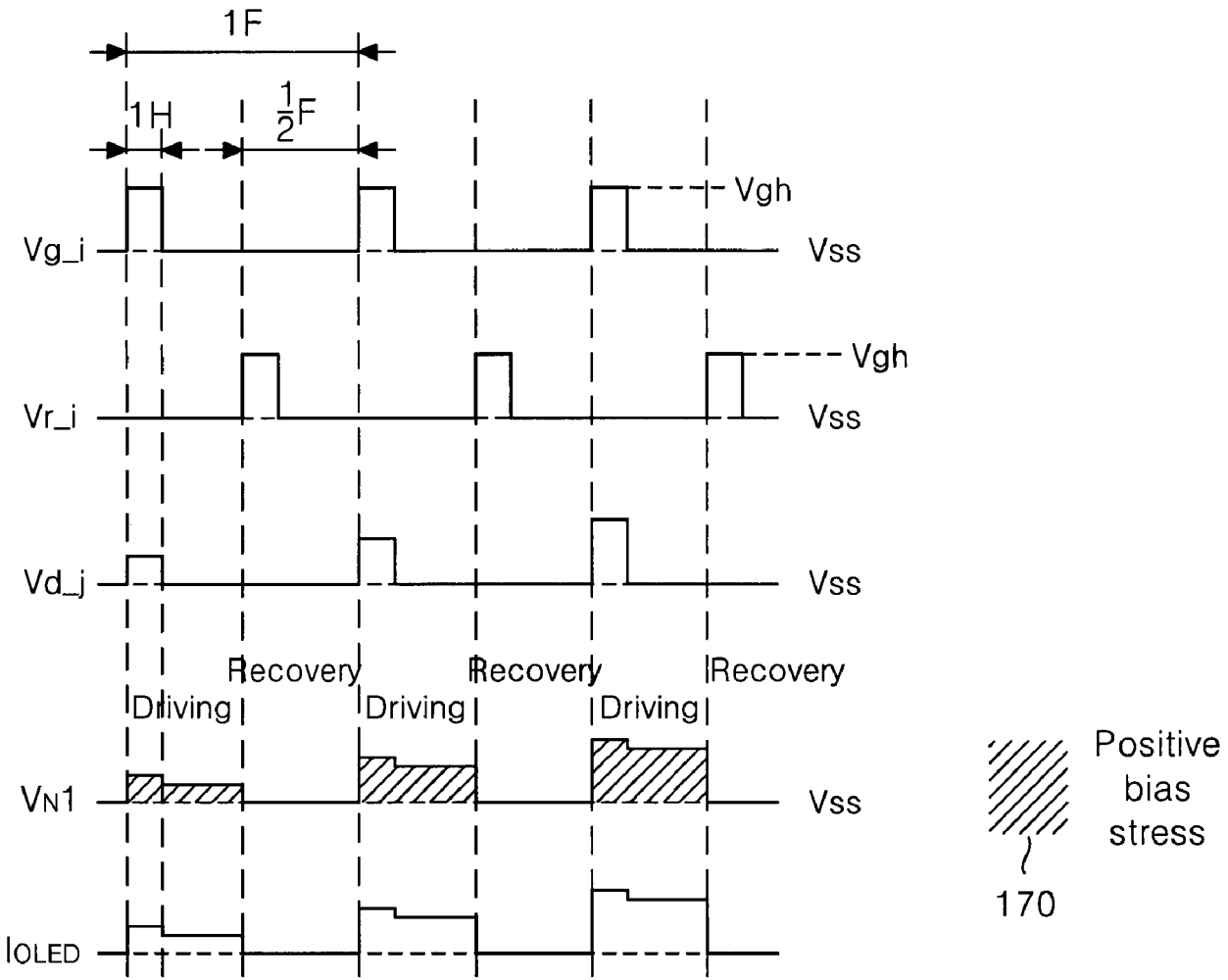
FIG. 7B illustrates driving waveforms that result in the positive gate bias stress of FIG. 7A.

In FIG. 7B, positive bias stress is illustrated with a slanted area 170. Positive bias stress resulting from the half period driving, although accumulated gradually, may be substantially recovered for the next half period. This may improve the reliability of the OLED drive circuit 105. The gate voltage of the second transistor T2 is discharged for a recovery period such that the reliability may improve.

Figure 8:
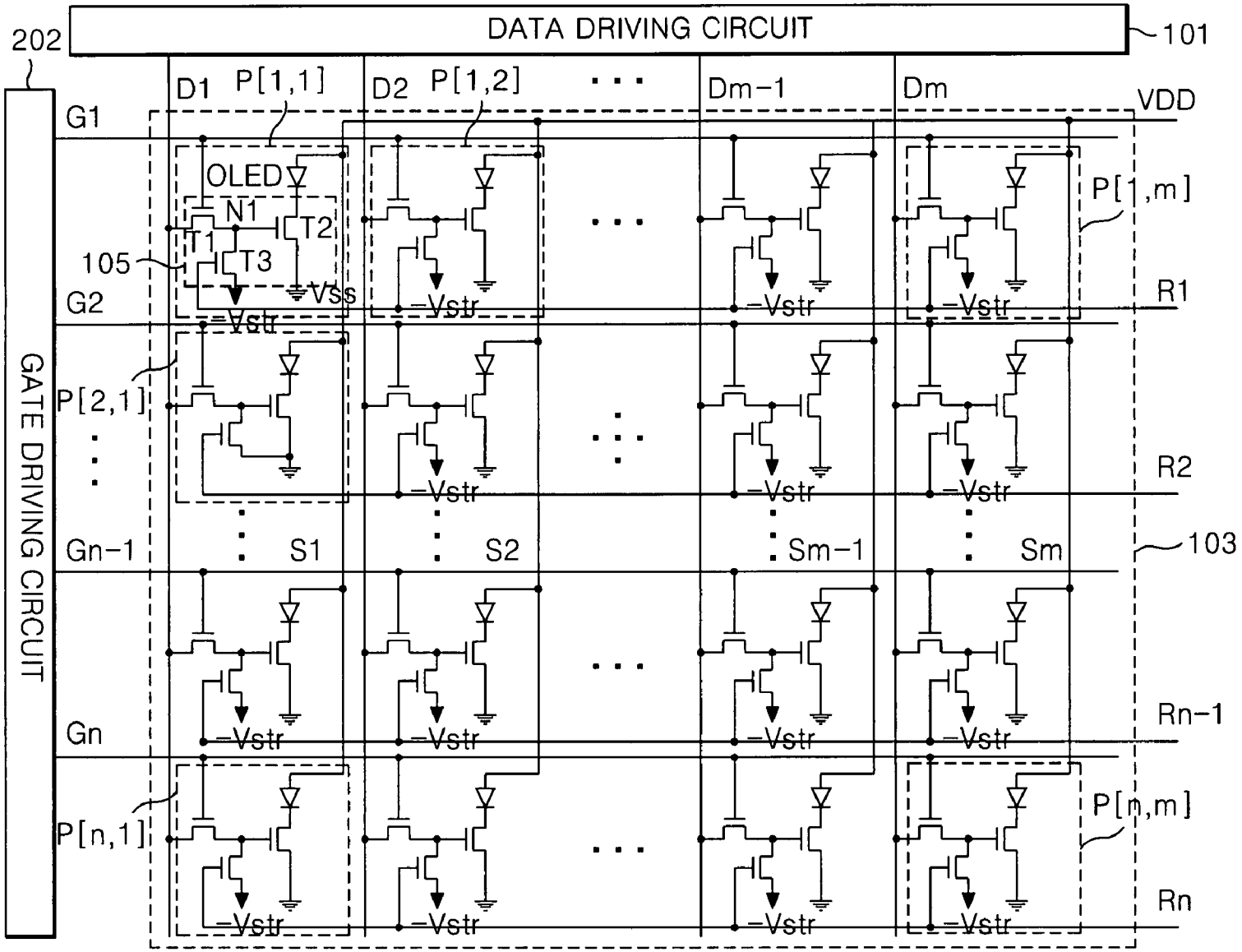
FIG. 8 is a block diagram illustrating another embodiment of an organic light emitting diode display device.

FIG. 8 is a block diagram of another embodiment of an OLED display device 200. The OLED display device 200 includes the data driving circuit 101, a gate driving circuit 202, the OLED panel 103 and an OLED drive circuit 205. The plurality of reset lines R1-Rn are provided in parallel to the plurality of gate lines G1-Gn. A negative stress voltage −Vstr is to be applied through the reset lines R1-Rn. The reset lines R1-Rn are connected to a source terminal of the third transistor T3, as shown in FIG. 8. The negative stress voltage is supplied to the source terminal of the third transistor T3 as in FIG. 8. The negative stress voltage −Vstr may reduce a low potential reference voltage, as will be described below in connection with FIGS. 9A and 9B. The gate drive circuit 202 generates a scan pulse which swings between a gate high voltage Vgh and the negative stress voltage −Vstr. The reset voltage rises from the negative stress voltage −Vstr, but the data voltage rises from Vss.

Figure 9A:
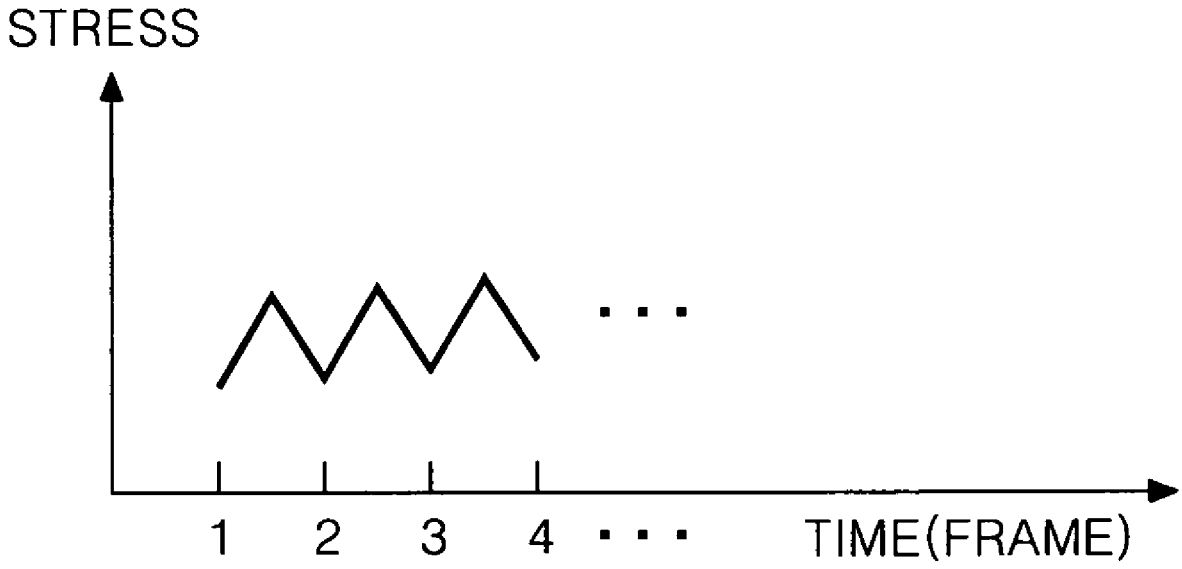
FIG. 9A illustrates negative gate bias stress experienced by the organic light emitting diode drive circuit of FIG. 8.

FIG. 9A illustrates exemplary negative bias stress that may be experienced by the OLED drive circuit 205. In FIG. 9A, a relatively low voltage is applied to the source electrode or terminal than the gate electrode or terminal of the second transistor T2 for the recovery period. As a result, experienced bias stress effect may be negative, and accumulated bias stress may be substantially minimized. As the negative bias stress effect becomes greater, the recovery characteristic of the OLED drive circuit 205 may increase. Because the gate bias stress is proportional to the magnitude of the applied voltage, application of a lower voltage is able to improve the reliability. The negative bias stress effect may be strengthened with application of the lower voltage. In this embodiment, the negative bias stress effect may be strengthened by supplying a lower potential reference voltage as shown in FIG. 9B.

Figure 9B:
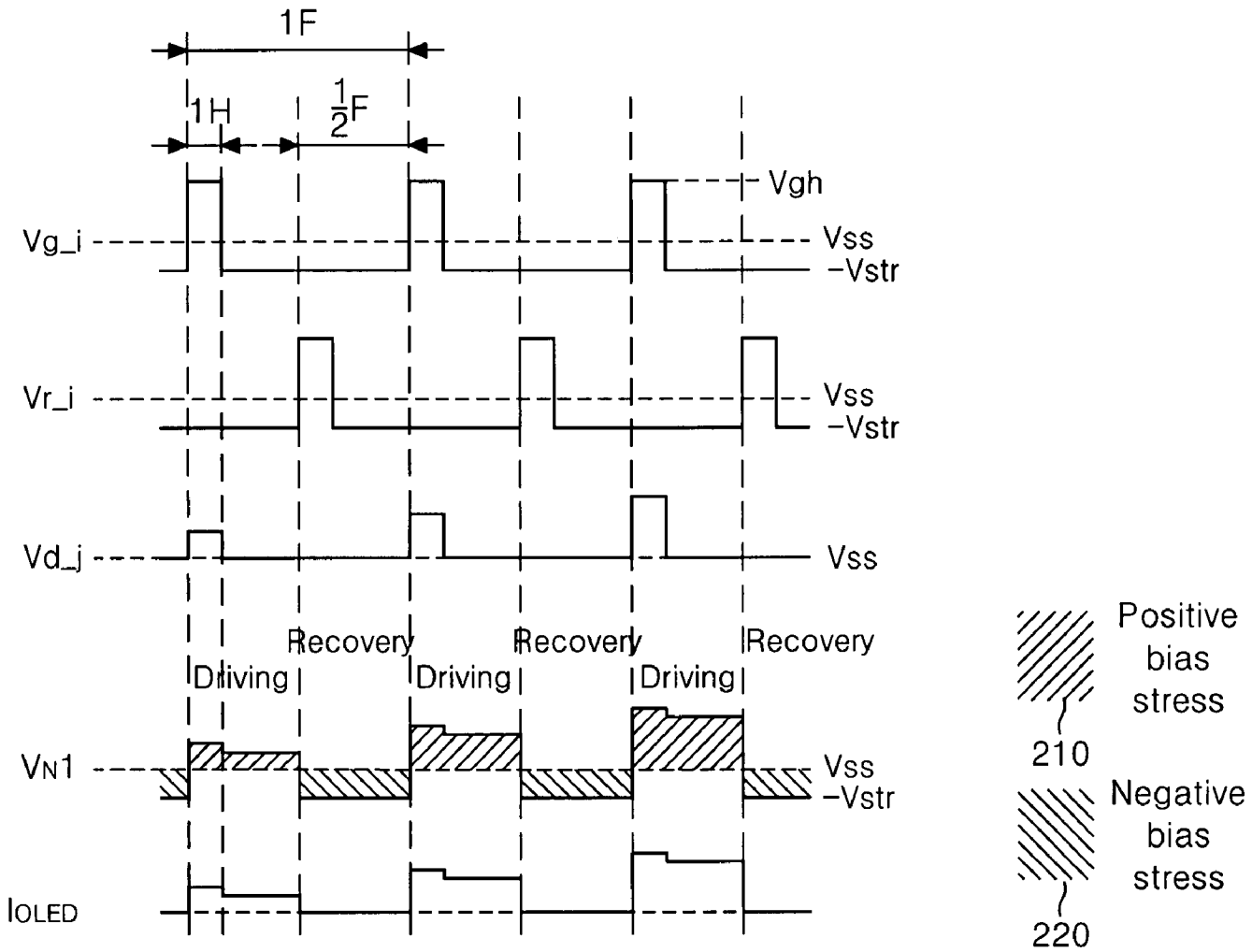
FIG. 9B illustrates driving waveforms that result in the negative gate bias stress of FIG. 9A.

FIG. 9B illustrates exemplary driving waveforms that result in negative bias stress. In FIG. 9B, positive bias stress is indicated with a first slant area 210 and negative bias stress is indicated with a second slant area 220. According to the driving waveform, low potential reference voltages of the reset voltage Vr_i waveform and/or the gate voltage Vg_i waveform are lower than a low potential reference voltage of the data voltage Vd_j. Assuming that the accumulated bias stress applied to the control node (the first node) of the second transistor T2 of the OLED drive circuit 205 may be proportional to slanted area 210, the accumulated bias stress may be minimized due to the low potential reference voltage corresponding to the rest voltage Vr_i and the gate voltage, Vg_i. As a result, the characteristic change may be substantially minimized. Further, the magnitude of the negative bias stress may be adjusted by controlling the low potential reference voltage. For convenience of description, the low potential reference voltage of the data voltage Vd_j is referred to as a first low potential reference voltage, and the low potential reference voltage of the reset voltage Vr_i and the gate voltage Vg_i are referred to as a second low potential reference voltage. This second low potential reference voltage may be relatively lower than the first low potential reference voltage. Accordingly, the accumulated bias stress may be minimized.

TFTs for use with the OLED drive circuit 205 may be implemented with an amorphous silicon type MOSFET TFT or a polysilicon type MOSFET TFT. As noted above, the second low potential reference voltage is lower than the first low potential reference voltage, as shown in FIG. 9B. Alternatively, only the low potential reference voltage of reset voltage Vr_i waveform may be lower than the low potential reference voltage of the data voltage Vd_j.

As described above, the OLED drive circuit includes the third transistor that discharges the control node of the OLED drive circuit in response to the reset pulse. The characteristic change caused by the deterioration of the OLED drive circuit may be prevented and the reliability of the operation may improve. In addition, the driving waveform having the low potential reference voltage of the reset pulse and the scan pulse lower than the low potential reference voltage of the data voltage is supplied to secure the reliability of the OLED drive circuit operation.

The organic light emitting diode driving circuit described above may be adaptive to compensate characteristic changes of the organic light emitting diode drive circuit. The reliability of operation of an OLED drive circuit may be secured and improve.

Although various embodiments are explained as described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An organic light emitting diode drive circuit, comprising:

an organic light emitting diode that emits light with a current;

a first transistor supplying a data voltage to a first node in response to a scan pulse;

a second transistor controlling the current flowing in the organic light emitting diode in response to the data voltage supplied to the first node; and a third transistor discharging the data voltage at the first node in response to a reset pulse for compensating a stress of the second transistor, wherein the third transistor is configured to be turned on subsequent to the first transistor and the first transistor is turned off when the third transistor is turned on, wherein a negative stress voltage lower than a low potential reference voltage of the data voltage is supplied to a source terminal of the third transistor and the negative stress voltage is equal with low potential voltages of the scan pulse and the reset pulse.

2. The organic light emitting diode drive circuit according to claim 1, wherein generation of the reset pulse is delayed by a ½ frame period from generation of the scan pulse.

3. The organic light emitting diode drive circuit according to claim 1, wherein the first to third transistors are configured to be amorphous silicon transistors or polysilicon transistors.

4. An organic light emitting diode display device, comprising:

data lines and gate lines that intersect each other;

a gate drive circuit supplying a scan pulse to the gate lines;

a data drive circuit supplying a video data voltage to the data lines;

an organic light emitting diode that emits light with a current; and an organic light emitting diode drive circuit including:

a first transistor supplying the video data voltage to a first node in response to the scan pulse;

a second transistor controlling a current flowing in the organic light emitting diode in response to the video data voltage at the first node; and a third transistor discharging the data voltage at the first node in response to a reset pulse for compensating a stress of the second transistor, wherein the third transistor is configured to be turned on subsequent to the first transistor and the first transistor is turned off when the third transistor is turned on, wherein a negative stress voltage lower than a low potential reference voltage of the data voltage is supplied to a source terminal of the third transistor and the negative stress voltage is equal with low potential voltages of the scan pulse and the reset pulse.

5. The organic light emitting diode display device according to claim 4, wherein generation of the reset pulse is delayed by a designated time from generation of the scan pulse.

6. The organic light emitting diode display device according to claim 5, wherein the generation of the reset pulse is delayed by a ½ frame period from the generation of the scan pulse.

7. The organic light emitting diode display device according to claim 4, wherein the first to the third transistors are configured to be amorphous silicon transistors or polysilicon transistors.

8. A driving method of an organic light emitting diode display device, comprising:

supplying a scan pulse to a plurality of gate lines;

supplying a data voltage to a plurality of data lines configured to intersect the gate lines;

supplying the data voltage to a first node through a first transistor, in response to the scan pulse;

controlling the current flowing in an organic light emitting diode through a second transistor, in response to the data voltage supplied to the first node;

supplying a reset pulse to a plurality of reset lines and discharging the data voltage at the first node for compensating a stress of the second transistor through a third transistor, in response to the reset pulse, wherein the third transistor is turned on subsequent to the first transistor and the first transistor is turned off when the third transistor is turned on, wherein a negative stress voltage lower than a low potential reference voltage of the data voltage is supplied to a source terminal of the third transistor and the negative stress voltage is equal with low potential voltages of the scan pulse and the reset pulse.

9. The driving method according to claim 8, wherein the data voltage is supplied to the first node of the second transistor during a half period of a frame and the reset voltage is supplied to the first node during a next half period of the frame, the data voltage and the reset voltage having opposite polarities.

* * * * *